US005439386A

United States Patent [19]

Ellis et al.

[11] Patent Number: 5,439,386

[45] Date of Patent: Aug. 8, 1995

[54] QUICK DISCONNECT ENVIRONMENTALLY SEALED RF CONNECTOR FOR HARDLINE COAXIAL CABLE

[75] Inventors: William H. Ellis, Mercer Island; Scott R. Hopper, Kent, both of Wash.

[73] Assignee: Augat Inc., Mansfield, Mass.

[21] Appl. No.: 255,393

[22] Filed: Jun. 8, 1994

[51] Int. Cl.[6] ..... H01R 13/622

[52] U.S. Cl. ..... 439/322; 439/271; 439/578

[58] Field of Search ..... 439/320, 322, 323, 675, 439/578, 271

[56] References Cited

U.S. PATENT DOCUMENTS

| | | | |
|---|---|---|---|
| 2,563,762 | 8/1951 | Uline et al. | 439/320 |
| 3,609,646 | 9/1971 | Becker | 439/523 |
| 3,697,928 | 10/1972 | Hammell | 439/157 |
| 3,719,918 | 3/1973 | Kerr | 439/319 |
| 3,725,849 | 4/1973 | Becke | 439/363 |
| 3,847,463 | 11/1974 | Hayward et al. | 439/28 |
| 3,874,761 | 4/1975 | Stauffer | 439/279 |
| 4,173,385 | 11/1979 | Fenn et al. | 439/277 |
| 4,268,115 | 5/1981 | Slemon et al. | 385/88 |
| 4,355,857 | 10/1982 | Hayward | 439/578 |
| 4,400,050 | 8/1983 | Hayward | 439/585 |
| 4,545,633 | 10/1985 | McGeary | 439/675 |
| 4,698,028 | 10/1987 | Caro et al. | 439/271 |
| 4,722,695 | 2/1988 | Zwicker et al. | 439/275 |
| 4,797,121 | 1/1989 | Hayward | 439/579 |
| 4,824,386 | 4/1989 | Souders | 439/133 |
| 4,854,893 | 8/1989 | Morris | 439/578 |
| 4,925,403 | 5/1990 | Zorzy | 439/578 |
| 4,944,699 | 7/1990 | Velke, Sr. et al. | 439/784 |
| 4,955,826 | 9/1990 | Potter et al. | 439/578 |
| 5,042,901 | 8/1991 | Merriken et al. | 385/135 |
| 5,271,080 | 12/1993 | Hopper et al. | 385/76 |

*Primary Examiner*—Gary F. Paumen

*Attorney, Agent, or Firm*—Weingarten, Schurgin, Gagnebin & Hayes

[57] ABSTRACT

An environmentally sealed quick disconnect RF connector for use with hardline coaxial cable. In one embodiment the RF connector includes a chassis portion for mounting on a chassis and an adaptor portion for connection to a hardline coaxial cable. The adaptor portion and the chassis portion are configured to provide a quick disconnect electrical connection. The adaptor portion includes a locking member for locking the chassis portion of the connector and the adaptor portion of the connector together once the chassis portion and the adaptor portion have been engaged. Prior to locking, the locking member permits the chassis portion of the connector and the adaptor portion of the connector to quickly engage. Following the quick engagement of the chassis portion of the connector with the adaptor portion of the connector, the threads of the locking member engage threads on the chassis portion of the connector and compress an o-ring seated in the chassis portion of the RF connector so as to lock the adaptor portion to the chassis portion and provide an environmental seal.

18 Claims, 7 Drawing Sheets

QUICK DISCONNECT ENVIRONMENTALLY SEALED RF CONNECTOR FOR HARDLINE COAXIAL CABLE

FIELD OF THE INVENTION

The invention relates generally to the field of RF connectors for hardline coaxial cable and more specifically to quick disconnect environmentally sealed RF connectors for trunk and distribution coaxial cable.

BACKGROUND OF THE INVENTION

Cable television distribution amplifiers or "nodes" typically have been constructed to include a weather and RF sealed housing and an RF amplifier module. The RF sealed housing provides the physical interface between the network distribution cable (called hardline cable due to the solid exposed outer conductor) and the RF amplifier module. The RF sealed housing, although environmentally sealed, allows heat generated inside the RF amplifier module to be conducted out to the environment.

Traditionally, the distribution cable is substantially permanently attached to the housing and covered with heat shrink tubing to provide a waterproof seal. When a failure occurs in the RF amplifier module within the housing, thereby requiring its replacement, the RF module is unplugged and replaced with a spare RF module. However, the housing, because of its semi-permanent attachment to the distribution cable is not as easily replaced.

What is desired is a quick disconnect environmentally sealed RF connector for use in connecting a chassis housing with hardline coaxial cable.

SUMMARY OF THE INVENTION

The invention relates to a quick disconnect environmentally sealed RF connector for use with hardline coaxial cable. In one embodiment the RF connector includes a chassis portion for mounting on a chassis and an adaptor portion for connection to a hardline coaxial cable. The adaptor portion and the chassis portion are configured to provide a quick disconnect electrical connection. The adaptor portion includes a locking member for locking the chassis portion of the RF connector and the adaptor portion of the RF connector together once the two have been engaged. Prior to locking, the locking member permits the chassis portion of the connector and the adaptor portion of the connector to quickly engage and disengage. Following the engagement of the chassis portion of the connector with the adaptor portion of the connector, the threads of the locking member engage threads on the chassis portion and compress an o-ring seated in the chassis portion of the connector so as to lock the adaptor portion to the chassis portion and provide an environmental seal.

DESCRIPTION OF THE DRAWINGS

This invention is pointed out with particularity in the appended claims. The above and further advantages of this invention may be better understood by referring to the following description taken in conjunction with the accompanying drawing, in which:

DETAILED DESCRIPTION OF THE INVENTION

In brief overview, the environmentally sealed quick disconnect RF connector for use with hardline coaxial cable includes a chassis mounting portion 6 (FIG. 1) for mounting on a chassis and an adaptor 8 (FIG. 3) for connecting and environmentally sealing the chassis mounting portion 8 to a hardline coaxial cable. In one embodiment, except as noted, the environmentally sealed quick disconnect RF connector is constructed of stainless steel.

Figure 1:
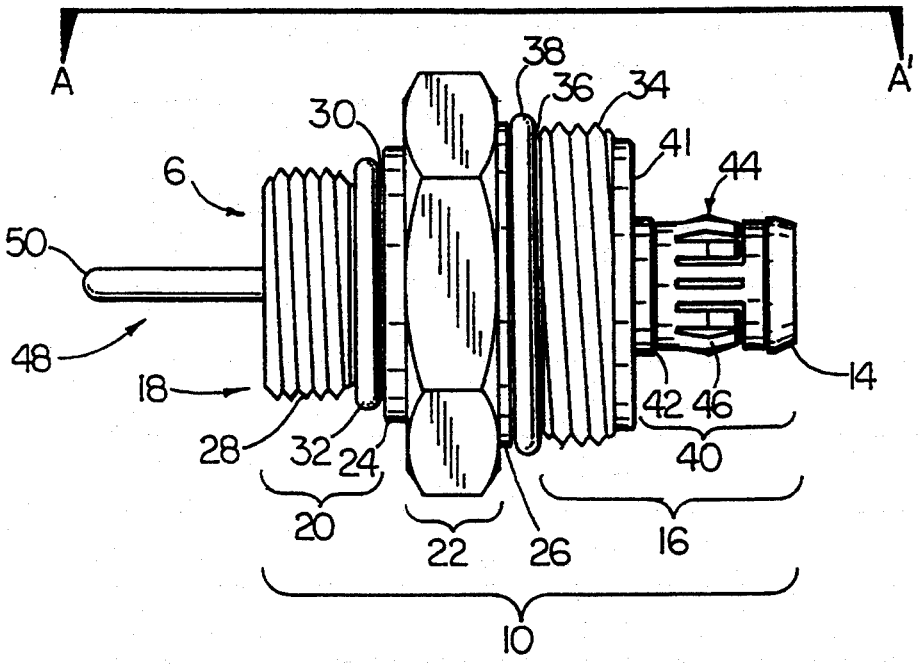
FIG. 1 is a side view of an embodiment of a chassis mounting portion of a quick disconnect environmentally sealed hardline coaxial cable RF connector of the invention.
Figure 2:
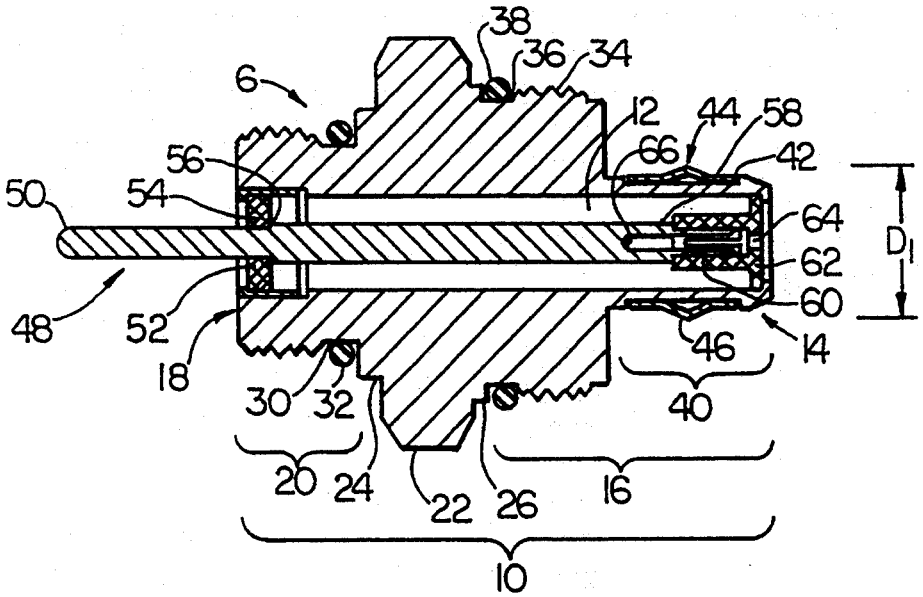
FIG. 2 is a cross sectional view through section line AA' of the embodiment of the invention shown in FIG. 1.

Considering each portion of the connector separately and in detail, and referring to FIGS. 1 and 2, the chassis mounting portion 6 of the RF connector includes a chassis mounting portion body 10 defining a bore 12 extending through the chassis mounting portion body 10 from an adaptor engaging end 14 of an adaptor engaging portion 16 to a chassis engaging end 18 of a chassis engaging portion 20. The central region 22 of the chassis mounting portion body 10 is in the form of a nut to provide a gripping surface by which rotation of the chassis mounting portion body 10 is accomplished as it is secured to a chassis wall.

The chassis mounting portion body 10 includes a pair of shoulders 24, 26 adjacent the central region 22. The chassis engaging portion 20 includes an externally threaded surface 28 which, in conjunction with a shoulder 24, forms an o-ring seat 30 within which is positioned a resilient o-ring 32.

When the chassis mounting portion 6 is mounted on a chassis housing, the externally threaded surface 28 is screwed into a mounting extrusion adaptor (see FIG. 7), pulling the chassis engaging portion 20 toward the chassis and compressing o-ring 32 between the external wall surface of the mounting extrusion adaptor and shoulder 24 of the chassis mounting portion body 10. The compressed o-ring 32 thereby provides an environmental seal preventing fluids and particulate matter from entering the chassis housing via the hole in which the chassis engaging portion 20 is located.

Similarly, the adaptor engaging portion 16 includes an externally threaded surface 34 which, in conjunction with a shoulder 26, forms an o-ring seat 36. Within this o-ring seat 36 is positioned a resilient o-ring 38. The function of the resilient o-ring 38 will be discussed in detail below with respect to the adaptor 8.

The adaptor engaging portion 16 further includes a facing surface 41 from which extends an adaptor engaging member 40 having a shallow groove 42 located circumferentially about its outer surface. Within the shallow groove 42 is positioned a resilient sleeve contact 44 having a plurality of spring members 46. Together, the spring members 46 and adaptor engaging member 40 have a combined diameter $D_1$. The function of the spring members 46 of the resilient sleeve contact 44 will be discussed in detail below in conjunction with the adaptor 8.

A central conductive pin 48 is located concentrically within bore 12. One end 50 of the central conductive pin 48 extends from bore 12 beyond the chassis mounting portion body 10. This end 50 of central conductive pin 48 extends axially through a dielectric disk 52 positioned within the chassis engaging end 18 of bore 12. The dielectric disk 52 may be constructed from any suitable dielectric material such as nylon. A hole 54 in the center of dielectric disk 52 is sized to accept the central conductive pin 48. The central conductive pin 48 includes a shoulder 56 which prevents the central conductive pin 48 from moving freely beyond shoulder 56 through hole 54.

The other end 58 of the central conductive pin 48, is shaped to receive a conductor pin and terminates within bore 12 in a conductor retention cavity 60 of a dielectric cylinder 62 located at the adaptor engaging end 14 of bore 12. Again this dielectric cylinder 62 may be constructed of a suitable dielectric material such as nylon. A hole 64 extends from pin retention cavity 60 through the dielectric cylinder 62. Hole 64 has a smaller diameter than the cavity shaped to receive a conductor pin in the end 58 of the central conductive pin 48. This hole 64 thus prevents a conductor pin having a larger diameter than hole 64 from entering end 58 of the central conductive pin 48 and thus damaging it.

Figure 3:
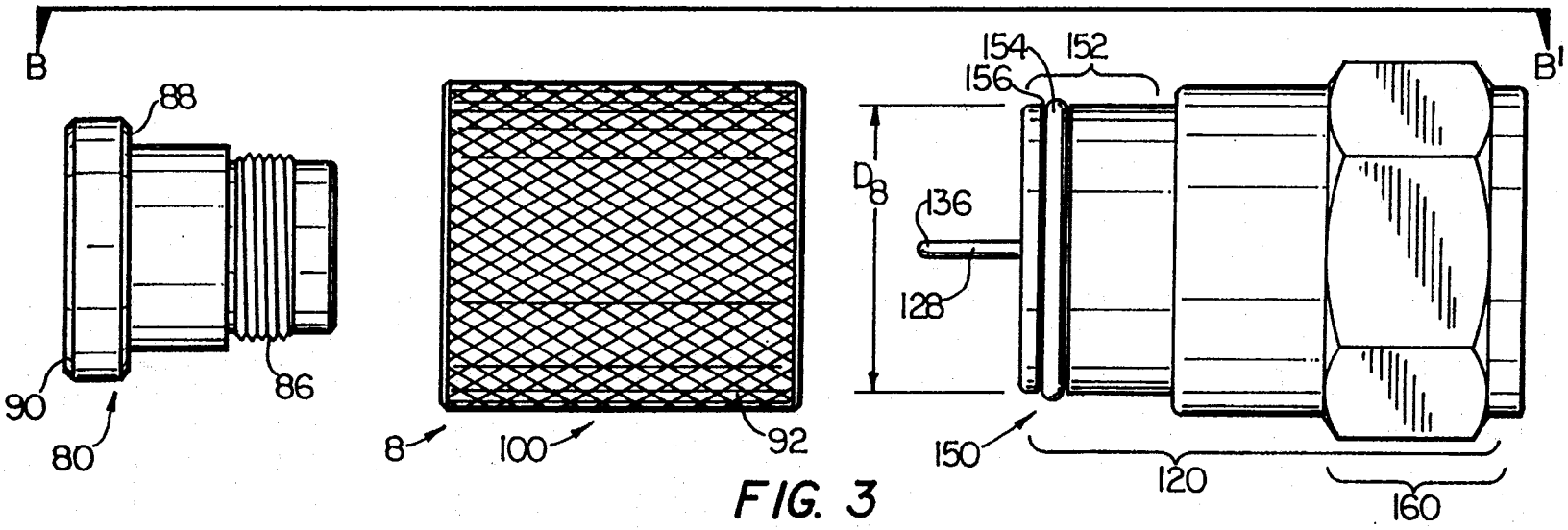
FIG. 3 is an exploded side view of an embodiment of an adaptor portion of a quick disconnect environmentally sealed hardline coaxial cable RF connector of the invention.
Figure 4:
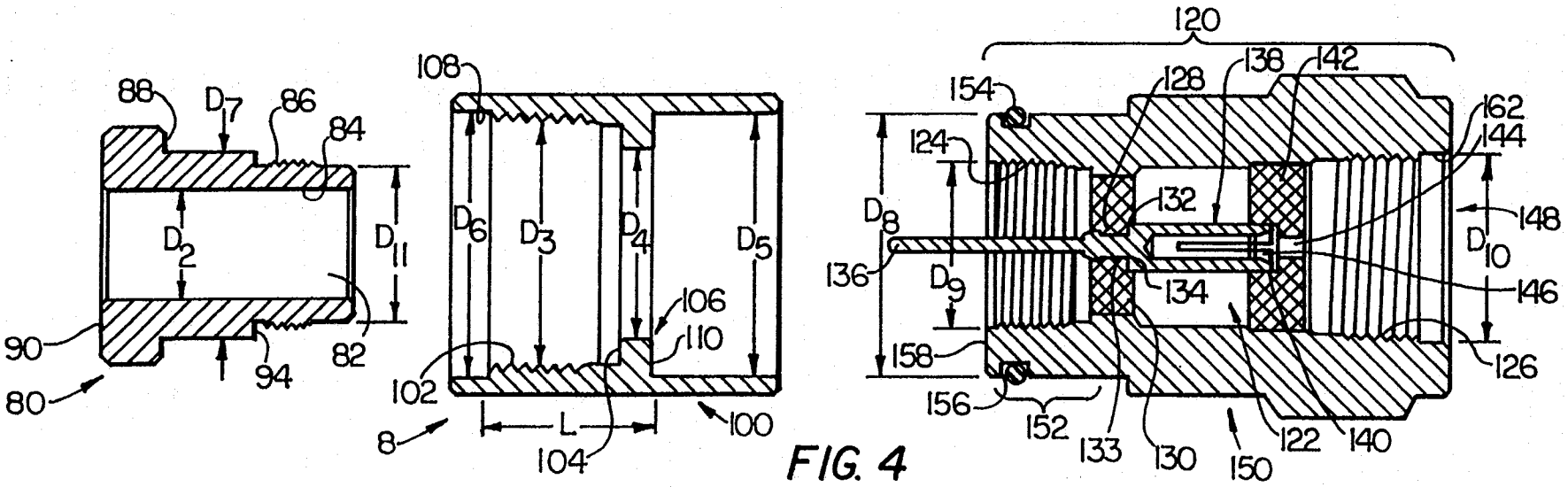
FIG. 4 is an exploded cross sectional view through section line BB' of the embodiment of the invention shown in FIG. 3.

Referring now to FIGS. 3 and 4, adaptor 8 includes a retaining member 80, a locking member 100 and a hardline cable member 150. Considering each of these members separately, retaining member 80 defines a bore 82. The bore 82 has a diameter $D_2$ slightly smaller than diameter $D_1$ of the combined adaptor engaging member 40 and spring members 46 of chassis mounting portion 6. Thus, when the adaptor engaging member 40 of the chassis mounting portion 6 engages the bore 82 of retaining member 80, the spring members 46 of the chassis mounting portion 6 deflect radially inward to permit adaptor engaging member 40 to enter the bore 82. The spring restoring force of the spring members 46 provides an outward pressure against the inner wall 84 of the bore 82 to thereby retain the adaptor engaging member 40 within the bore 82. Thus, the raised spring members 46 of the resilient sleeve contact 44 provide the force necessary for the chassis mounting portion 6 to securely engage the adaptor 8, while still providing a quick disconnect capability.

In one embodiment, the retaining member 80 includes external threads 86, a retaining shoulder 88 and a facing surface 90. The external threads 86 anchor the retaining member 80 within the hardline cable member 150, and the retaining shoulder 88 retains the locking member 100 between the retaining member 80 and the hardline cable member 150. These components will be explained in greater detail in the discussion of the locking member 100 and hardline cable member 150 below. When the adaptor engaging member 40 is fully within the bore 82 of retaining member 80, facing surface 90 of retaining member 80 is in contact with facing surface 41 of chassis mounting portion 6.

Locking member 100 is in one embodiment a cylindrically shaped tube, with knurling 92 on its outer surface. The locking member 150 defines four internal diameters $D_3$, $D_4$, $D_5$ and $D_6$. In one embodiment, internal diameter $D_3$ has internal threads 102 and is sized and threaded to engage the externally threaded surface 34 of chassis mounting portion 6. Internal diameter $D_4$ is sized to accept the outer diameter $D_7$ of retaining member 80 and to permit locking member 100 to move axially over retaining member 80 in the direction of retaining member 80 until side 104 of ridge 106 makes contact with retaining shoulder 88 of retaining member 80. Diameter $D_6$ is slightly larger than diameter $D_3$ and is sized to compress o-ring 38 of chassis mounting portion 6 between the inner wall 108 of locking member 100 and o-ring seat 36 of chassis mounting portion 6 when internal threads 102 of locking member 100 have completely engaged externally threaded surface 34 of chassis mounting portion 6, thereby providing an environmental seal between the adaptor 8 and the chassis mounting portion 6.

Hardline cable member 150 includes a body 120 defining a bore 122 having various diameters at different locations within the bore 122. The diameter $D_9$ at one end of the bore 122 is sized and has internal threads 124 to receive external threads 86 of retaining member 80. The other end of the bore 122 defines an orifice 148 having a diameter $D_m$ which is sized and has threads 126 to receive the external threads of a hardline coaxial cable.

Within the bore 122 is a conduction pin 128 oriented coaxially with the boar 122. One end 132 of the conduction pin 128 extends from bore 122. Conduction pin 128 passes through a hole 133 in a dielectric disc 130 located within bore 122 which holds the conduction pin 128 coaxially within bore 122. The dielectric disc 130 includes a depression 132 of slightly larger diameter than hole 133 which engages a shoulder 134 of conduction pin 128 thereby preventing conduction pin 128 from moving further through the dielectric disc 130 beyond shoulder 134. The receiving end 138 of conduction pin 128, is shaped to receive a central conductor pin of a hardline coaxial cable, terminates within bore 128 in a conduction pin retention cavity 140 of a dielectric disc 142 located near the hardline coaxial cable engaging end of bore 128. A hole 144 extends from conduction pin retention cavity 140 through the dielectric disc 142. Hole 144 has a slightly smaller diameter than does the receiving orifice 146 of conduction pin 128 in order to prevent a central conductor pin of a hardline coaxial cable having a larger diameter than the receiving orifice 146 of conduction pin 128 from engaging and damaging the receiving orifice 146 of conduction pin 128. As in the chassis mounting portion 6, the dielectric components of the adaptor 8 may be constructed from any appropriate material such as nylon.

The outer surface of hardline cable member 150 includes nut portion 160 and a sealing portion 152. Diameter $D_5$ of locking member 100 is sized to fit over sealing portion 152 at one end of hardline cable member 150. Sealing portion 152 is cylindrical in shape and includes an o-ring 154 positioned within an o-ring seat 156 located at the locking member engaging side of the headline cable member 150. Diameter $D_5$ is slightly larger than the diameter $D_8$ of sealing portion 152. This permits locking member 100 to move over sealing portion 152 until side 110 of ridge 106 of locking member 100 makes contact with face 158 of hardline cable member 150 while still compressing o-ring 154 sufficiently to form an environmental seal.

Figure 5:
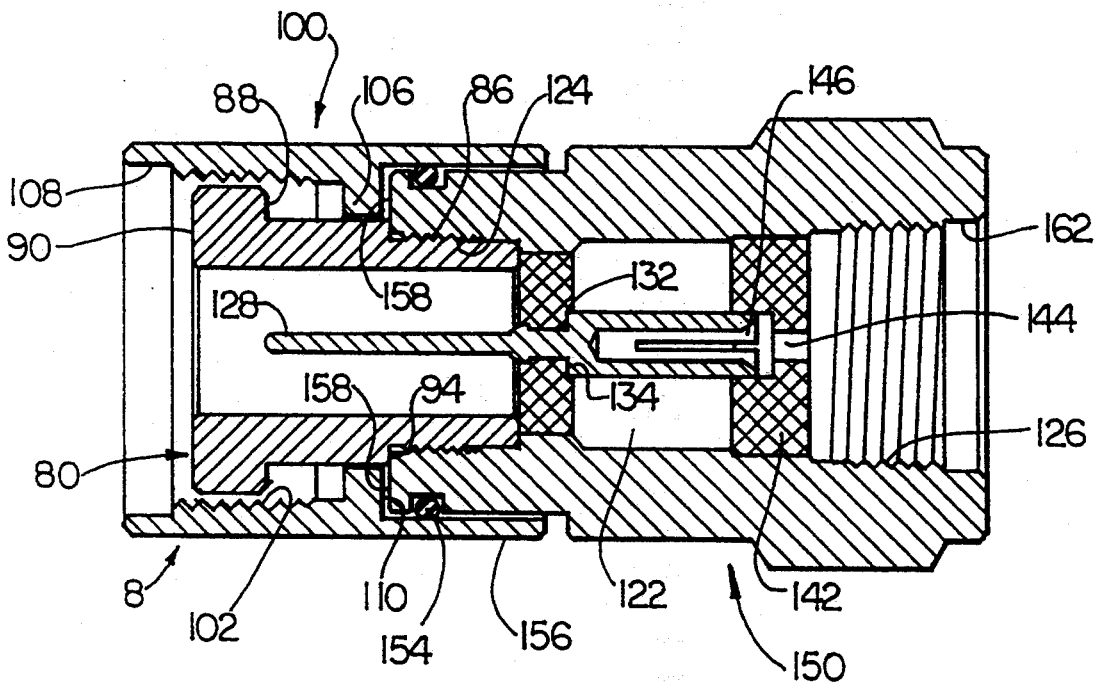
FIG. 5 is an assembled cross sectional view of the embodiment of the invention shown in FIG. 4.

Referring also to FIG. 5, to assemble adaptor 8, sealing portion 152 of hardline cable member 150 engages locking member 100 until face 158 of hardline cable member 150 touches side 110 of locking member 100. At this point, external threads 86 of retaining member 80 engage the internal threads 124 of hardline cable member 150 until shoulder 94 makes contact with face 158 of hardline cable member 150. This results in ridge 106 of locking member 100 being retained within a cavity created by retaining shoulder 88 of retaining member 80 and face 158 of hardline cable member 150. When assembled, ridge 106 of locking member 100 is capable of moving between retaining shoulder 88 of retaining member 80 and face 158 of hardline cable member 150 while o-ring 154 maintains an environmental seal between the locking member 100 and the sealing portion 152 of hardline cable member 150. When assembled, conduction pin 128 of hardline cable member 150 is positioned within bore 82 of retaining member 80.

It should be noted that in another embodiment retaining member 80 does not have external threads 86 and hardline cable member 150 does not have internal threads 124 for firmly attaching the retaining member 80 to the hardline cable member 150. In an alternative embodiment, retaining member 80 is firmly attached to the hardline cable member 150 by selecting a bore diameter $D_9$ for hardline cable member 150 which is approximately the same diameter as outer diameter $D_{11}$ of retaining member 80 and press fitting the two together. Such a press fit connection between the retaining member 80 and the hardline cable member 150 is the preferred embodiment.

Figure 6:
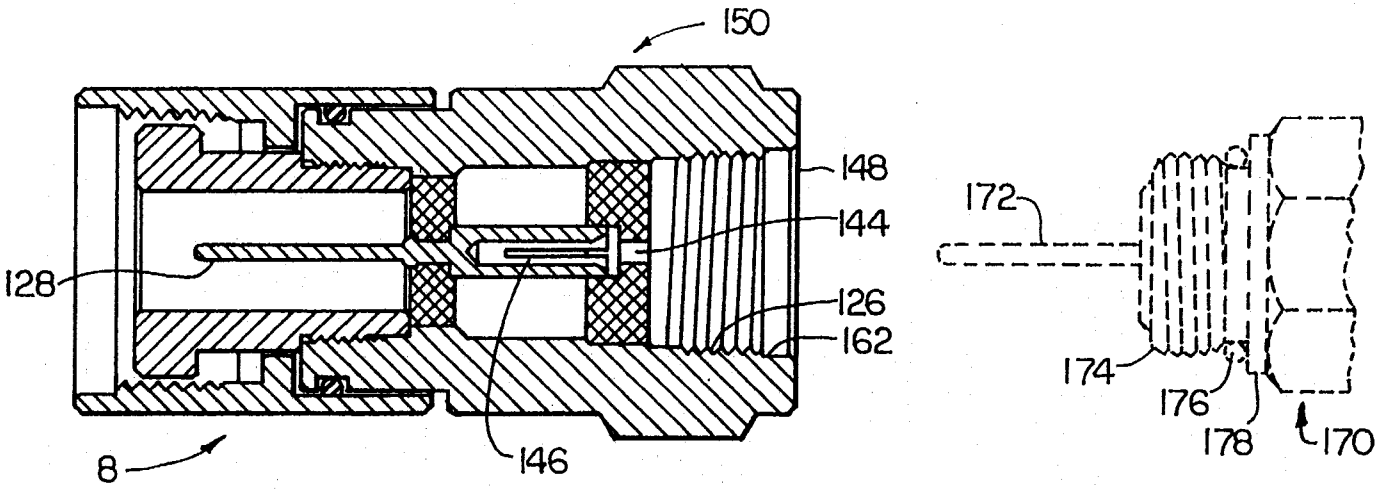
FIG. 6 is an assembled cross sectional view of the embodiment of the invention shown in FIG. 5 positioned for mating with a hardline coaxial cable.
Figure 6A:
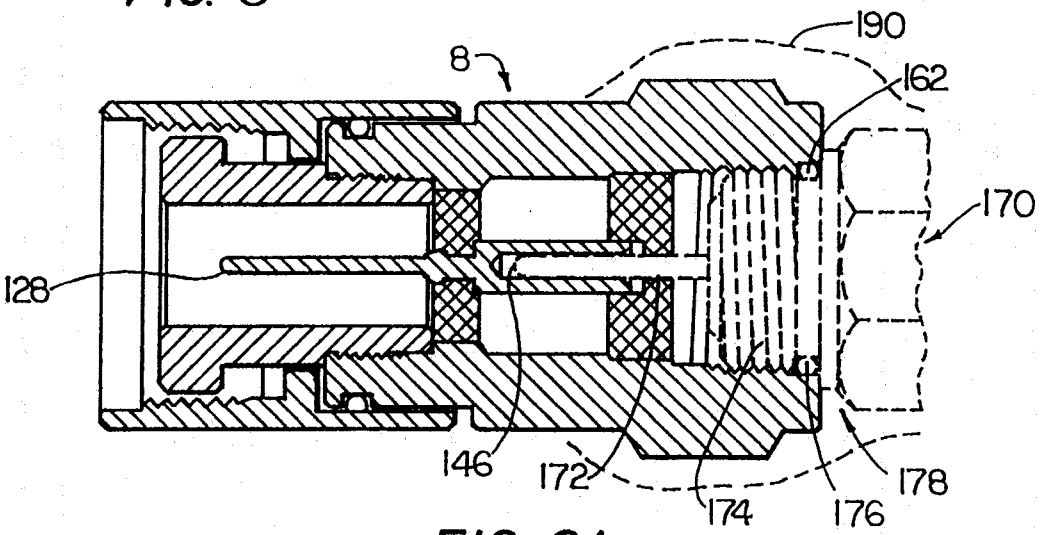
FIG. 6*a* is an assembled cross sectional view of the embodiment of the invention shown in FIG. 5 mated with a hardline coaxial cable.

Referring also to FIGS. 6 and 6*a*, to attach adaptor 8 to a hardline coaxial cable assembly 170 (shown in phantom), the hardline cable member 150 is aligned such that hardline coaxial cable orifice 148 is axially positioned so as to align hole 144 with hardline coaxial cable conductor pin 172. Coaxial cable conductor pin 172 is inserted through hole 144 into receiving orifice 146 of conduction pin 128. Once coaxial cable conductor pin 172 engages receiving orifice 146 of conduction pin 128, the external threads 174 of hardline coaxial cable assembly 170 engage the internal threads 126 of hardline cable member 150. When the hardline coaxial cable assembly 170 is fully engaged with adaptor 8, the o-ring 176 of the hardline coaxial cable assembly 170 is compressed between shoulder 178 of hardline coaxial cable assembly 170 and shoulder 162 of the hardline cable member 150, forming an environmental seal. For additional environmental protection the region of engagement between the hardline coaxial cable assembly 170 and adaptor 8 may be sealed within shrink wrap tubing 190 (shown in phantom).

Figure 7:
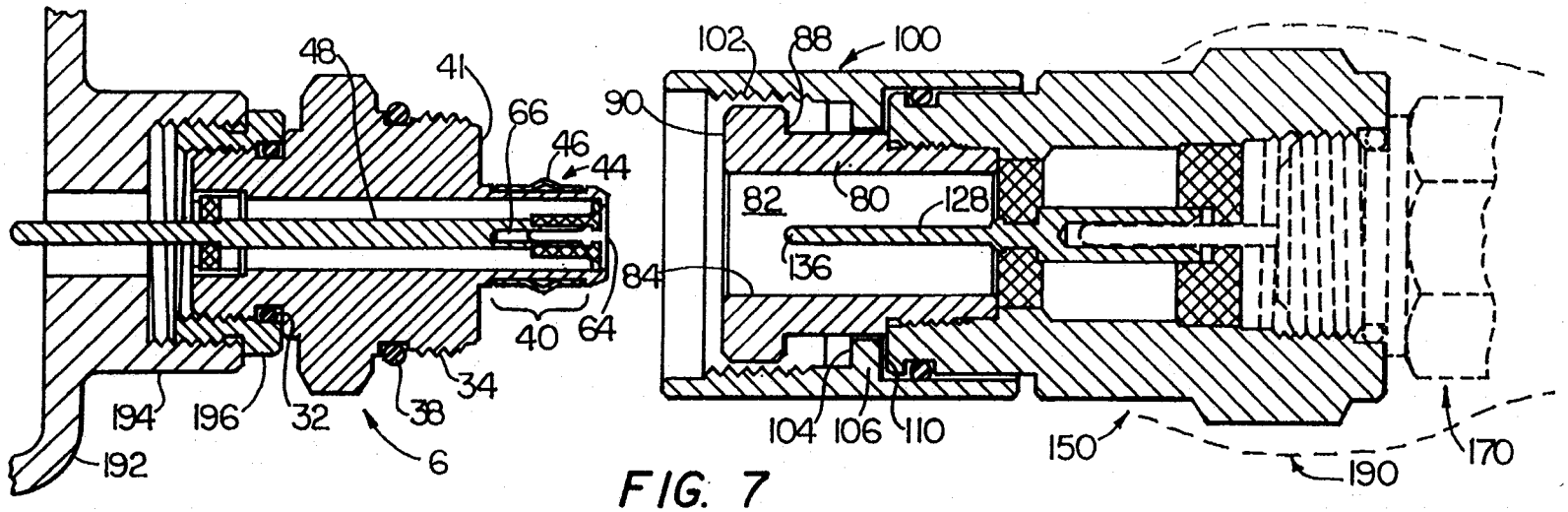
FIG. 7 is an assembled cross sectional view of the embodiment of the invention shown in FIG. 6a mated with a hardline coaxial cable and positioned for mating with the embodiment of the chassis portion of the invention shown in FIG. 2.
Figure 7A:
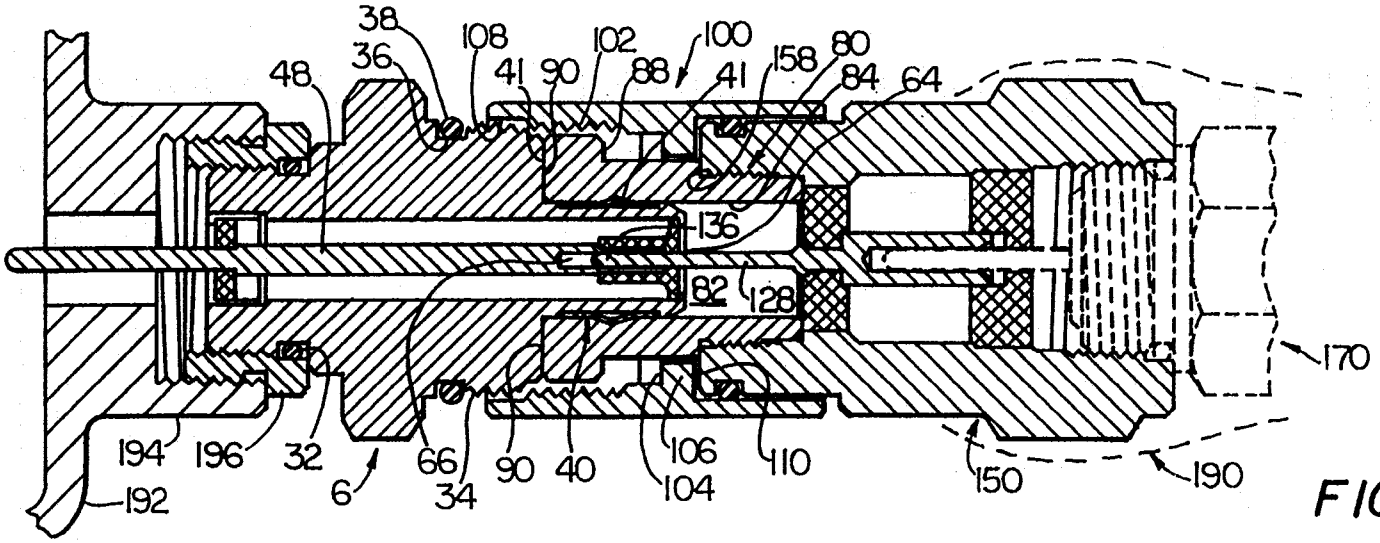
FIG. 7*a* is an assembled cross sectional view of the embodiment of the invention shown in FIG. 6*a* mated with a hardline coaxial cable and mated with the embodiment of the chassis portion of the invention shown in FIG. 2 but prior to being locked in position.
Figure 7B:
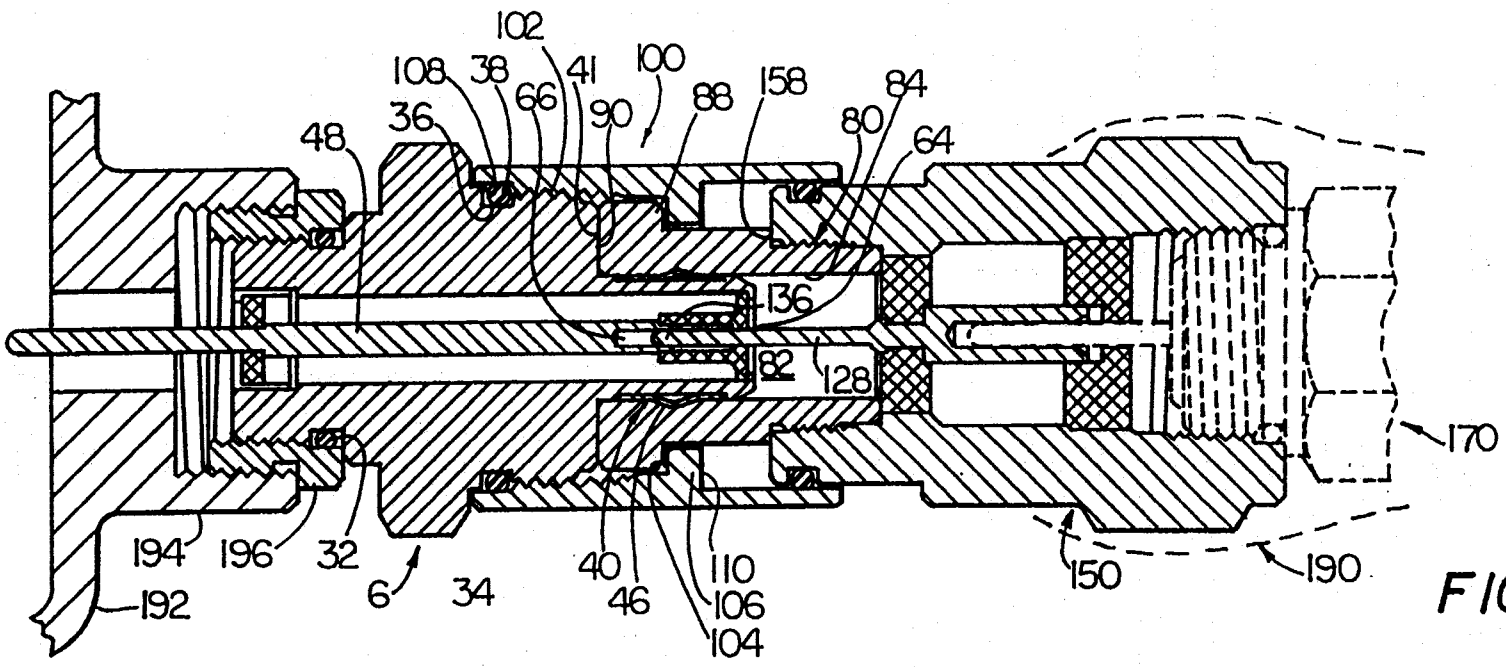
FIG. 7*b* is an assembled cross sectional view of the embodiment of the invention shown in FIG. 6*a* mated with a hardline coaxial cable and mated and locked with the embodiment of the chassis portion of the invention shown in FIG. 2.

Once the adaptor 8 has been mated with hardline coaxial cable assembly 170, the mated adaptor 8 and hardline coaxial cable assembly 170 may be connected to the chassis mounting portion 6. FIGS. 7, 7*a* and 7*b*, depict the steps needed to engage the combined adaptor 8 and hardline coaxial cable assembly 170 with the chassis mounting portion 6 mounted on chassis 192 (shown in phantom) and held in place by engagement with an extrusion portion adaptor 196 screwed into an extrusion portion 194 (also shown in phantom).

First, conduction pin 128 of adaptor 8 is axially aligned with hole 64 of chassis mounting portion 6 (FIG. 7). Adaptor engaging member 40 is then inserted into bore 82 of retaining member 80. Adaptor 8 and chassis mounting portion 6 are then moved together until facing surface 41 of chassis mounting portion 6 makes contact with facing surface 90 of retaining member 80 (FIG. 7*a*). At this point, end 136 of conduction pin 128 penetrates hole 64 and engages pin receiving cavity 66 of central conductive pin 48.

As the chassis mounting member 6 is engaging adaptor 8, locking member 100 is positioned toward hardline cable member 150 such that side 110 of ridge 106 makes contact with face 158 of hardline cable member 150. With the locking member 100 in this position, the lead thread of internal threads 102, located at a distance L (FIG. 4) from side 110 of ridge 106, is at a position which is less than the distance from the lead thread of threaded surface 34 of the chassis mounting member 6 to side 110 of ridge 106 of the adaptor 8.

Therefore, with the locking member 100 positioned such that side 110 of ridge 106 is against face 158 of hardline cable member 150, internal threads 102 of locking member 100 do not engage the externally threaded surface 34 of chassis mounting portion 6. However, although the adaptor 8 and the chassis mounting portion 6 are not locked together, the spring members 46 of resilient sleeve contact 44 press against the inner wall 84 of the bore 82 and hold the chassis mounting portion 6 firmly to the adaptor 8, thereby maintaining electrical continuity between conduction pin 128 and central conductive pin 48.

To lock the chassis mounting portion 6 and the adaptor 8 together (FIG. 7*b*), locking member 100 slides toward chassis mounting portion 6 until the internal threads 102 engage the externally threaded surface 34. Locking member 100 is then caused to rotate and thereby cause internal threads 102 of locking member 100 to fully engage the externally threaded surface 34 of the chassis mounting portion 6. At this point, side 104 of ridge 106 of locking member 100 makes contact with retaining shoulder 88 and inner wall 108 of locking member 100 compresses o-ring 38 within o-ring seat 36 thus forming an environmental seal between the chassis mounting portion 6 and the locking member 100 and firmly locking chassis mounting portion 6 and adaptor 8 together.

Thus, the operation of mating adaptor 8 with chassis mounting portion 6 or disconnecting adaptor 8 from chassis mounting portion 6 may be accomplished very quickly. Once the chassis mounting portion 6 and the adaptor 8 are engaged and electrical contact established, the two components are then locked together, without effecting the transmission of the signal. A unit having a chassis mounting portion 6 may be disconnected from a hardline coaxial cable and a new unit attached while minimizing the actual amount disconnect time.

Figure 8:
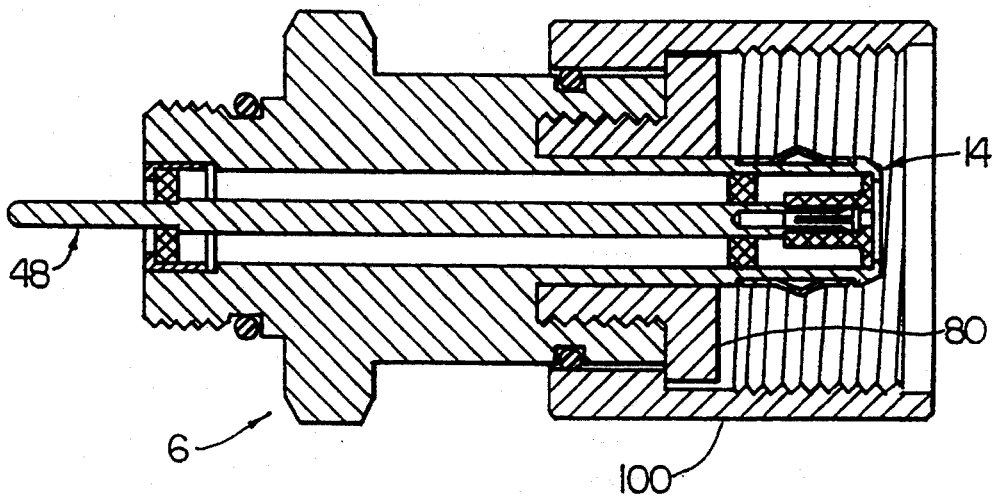
FIG. 8 is an assembled cross-sectional view of another embodiment of a chassis mounting portion of the invention.
Figure 8A:
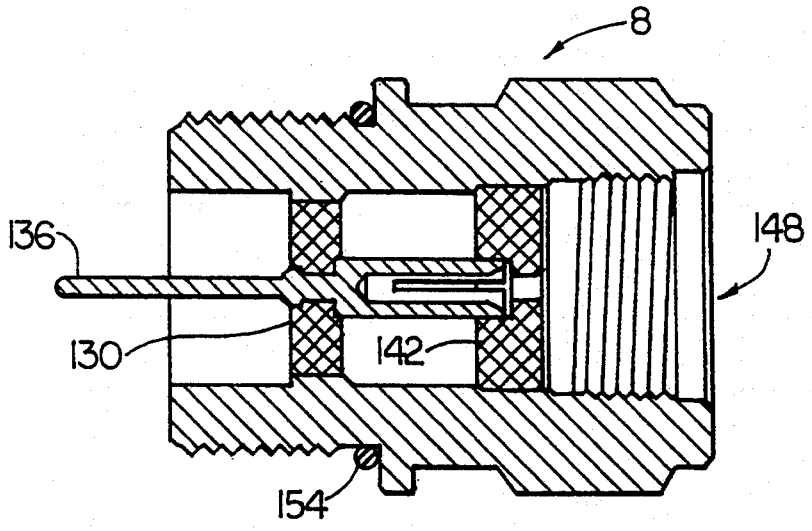
FIG. 8*a* is an assembled cross-sectional view of another embodiment of an adaptor of the invention.

It should be noted that although in the embodiment shown the adaptor 8 includes retaining member 80 and locking member 100, it is possible to construct an equivalent device in which the chassis mounting portion 6 includes the retaining member and the locking member (FIGS. 8 and 8*a*). Similarly, the various mating members, for example adaptor engaging member 40 of chassis mounting portion 6 and bore 82 of adaptor portion 8, may be exchanged with their corresponding mating halves without significant effect. Therefore the chassis mounting portion 6 may be designed to incorporate a bore and the adaptor 8 may be designed to incorporate an engaging member without any change in functionality.

Having shown the preferred embodiment, those skilled in the art will realize many variations are possible which will still be within the scope and spirit of the claimed invention. Therefore, it is the intention to limit the invention only as indicated by the scope of the claims.

What is claimed is:

1. An environmentally sealed quick disconnect RF connector for use with hardline coaxial cable, said connector comprising:

a chassis mounting portion comprising:

a first central conductor;

a threaded surface; and an o-ring positioned adjacent to said threaded surface; and an adaptor comprising:

a coaxial cable portion having a first end and a second end portion, said first end of said coaxial cable portion for attachment to a hardline coaxial cable;

a second central conductor; and a locking member including an inner wall, and having a threaded surface sized and threaded to engage said threaded surface of said chassis mounting portion, said locking member attached to and movably positioned upon said second end portion of said coaxial cable portion and movable relative thereto between:

a first unlocked position wherein said threaded surface of said locking member does not engage said threaded surface of said chassis mounting portion when said second central conductor of said adaptor and said first central conductor of said chassis mounting portion are electrically continuous, and a second locked position wherein said threaded surface of said locking member engages said threaded surface of said chassis mounting portion when said second central conductor of said adaptor and said first central conductor of said chassis mounting portion are electrically continuous, and wherein said inner wall of said locking member compresses said o-ring positioned adjacent to said threaded surface of said chassis mounting portion to thereby form an environmental seal between said chassis mounting portion and said adaptor, whereby said adaptor may be pulled from said chassis mounting portion when said second central conductor of said adaptor and said first central conductor of said chassis mounting portion are electrically continuous and said locking member is in said unlocked position.

2. The connector of claim 1, wherein said adaptor further comprises a retaining member, said retaining member engaging said second end portion of said coaxial cable portion thereby retaining said locking member upon said second end portion of said coaxial cable portion when said adaptor is disengaged from said chassis mounting portion.

3. The connector of claim 2 wherein said retaining member includes a retaining shoulder, said second end portion of said coaxial cable portion includes a facing surface and said locking member includes an internal ridge, said internal ridge of said locking member in said first unlocked position being substantially adjacent said facing surface of said second end portion of said coaxial cable portion, and said internal ridge of said locking member in said second locked position being substantially adjacent said retaining shoulder of said retaining member.

4. The connector of claim 1, wherein said adaptor further comprises an o-ring located between said locking member and said second end portion of said coaxial cable portion, said o-ring forming an environmental seal between said locking member and said second end portion of said coaxial cable portion when said locking member is in said first unlocked position and when said locking member is in said second locked position.

5. The connector of claim 1 wherein said adaptor defines a bore and said chassis mounting portion further includes a adaptor engaging portion, said adaptor engaging portion of said chassis mounting portion sized to mate with said bore of said adaptor and frictionally engaging said bore of said adaptor when said chassis mounting portion and said adaptor are engaged.

6. The connector of claim 3 wherein said retaining member defines the bore of said adaptor.

7. The connector of claim 6 wherein said coaxial cable portion defines a bore extending from said first end of said coaxial cable portion to said second end portion of said coaxial cable portion, said bore of said coaxial cable portion being coaxial with said bore of said adaptor.

8. The connector of claim 5 wherein said coaxial cable portion defines a bore extending from said first end of said coaxial cable portion to said second end portion of said coaxial cable portion, said bore of said coaxial cable portion being said bore of said adaptor.

9. The connector of claim 5 wherein said second central conductor of said adaptor comprises a conducting pin located within and coaxial with said bore of said adaptor.

10. The connector of claim 9 wherein said chassis mounting portion defines a bore and wherein said first central conductor of said chassis mounting portion further comprises a conducting pin located within and coaxial with said bore of said chassis mounting portion.

11. The connector of claim 10 wherein said conducting pin of said chassis mounting portion and said conducting pin of said adaptor are electrically continuous when said second central conductor of said adaptor and said first central conductor of said chassis mounting portion are engaged.

12. An environmentally sealed quick disconnect RF connector for use with hardline coaxial cable, said connector comprising:

a chassis mounting portion having a first engaging member and a first central conductor; and an adaptor having a coaxial cable portion for attachment to a hardline coaxial cable, a chassis engaging portion having a second engaging member configured to engage with said first engaging member of said chassis mounting portion, and a second central conductor, one of said chassis mounting portion and said adaptor including a locking member, said locking member movable between:

a first unlocked position wherein said locking member does not engage the other of said chassis mounting portion and said adaptor when said first engaging member of said chassis mounting portion and said second engaging member of said adaptor are engaged, and said first central conductor and said second central conductor are electrically engaged, and a second locked position wherein said locking member engages the other of said chassis mounting portion and said adaptor when said first engaging member of said chassis mounting portion and said second engaging member of said adaptor are engaged, and said first central conductor and said second central conductor are electrically engaged, thereby forming an environmental seal between said adaptor and said chassis mounting portion, whereby said adaptor may be pulled from said chassis mounting portion when said second central conductor of said adaptor and said first central conductor of said chassis mounting portion are electrically engaged and said locking member is in said unlocked position.

13. The connector of claim 12 wherein said chassis mounting portion further comprises a threaded surface and an o-ring positioned adjacent to said threaded surface, and wherein said locking member includes an inner wall and has a threaded surface sized and threaded to engage said threaded surface of said chassis mounting portion, said locking member movably positioned upon said chassis engaging portion and movable between:

said first unlocked position wherein said threaded surface of said locking member does not engage said threaded surface of said chassis mounting portion when said second central conductor of said adaptor and said first central conductor of said chassis mounting portion are electrically continuous, and said second locked position wherein said threaded surface of said locking member engages said threaded surface of said chassis mounting portion when said second central conductor of said adaptor and said first central conductor of said chassis mounting portion are electrically continuous, and wherein said inner wall of said locking member compresses said o-ring positioned adjacent to said threaded surface of said chassis mounting portion to thereby form an environmental seal between said chassis mounting portion and said adaptor.

14. The connector of claim 13, wherein said adaptor further comprises an o-ring located between said locking member and said chassis engaging portion, said o-ring forming an environmental seal between said locking member and said chassis engaging portion when said locking member is in said first unlocked position and when said locking member is in said second locked position.

15. The connector of claim 12 wherein said chassis engaging portion comprises a threaded surface and an o-ring positioned adjacent to said threaded surface, and wherein said locking member has a threaded surface sized and threaded to engage said threaded surface of said chassis engaging portion and wherein said locking member includes an inner wall, said locking member movably positioned upon said chassis mounting portion and movable between:

said first unlocked position wherein said threaded surface of said locking member does not engage said threaded surface of said chassis engaging portion when said second central conductor of said adaptor and said first central conductor of said chassis mounting portion are electrically continuous, and said second locked position wherein said threaded surface of said locking member engages said threaded surface of said chassis engaging portion when said second central conductor of said adaptor and said first central conductor of said chassis mounting portion are electrically continuous, and wherein said inner wall of said locking member compresses said o-ring positioned adjacent to said threaded surface of said chassis engaging portion to thereby form an environmental seal between said chassis mounting portion and said adaptor.

16. The connector of claim 15, wherein said chassis mounting portion further comprises an o-ring located between said locking member and chassis mounting portion, said o-ring forming an environmental seal between said locking member and said chassis mounting portion when said locking member is in said first unlocked position and when said locking member is in said second locked position.

17. The connector of claim 12 wherein said adaptor further comprises a threaded surface and an o-ring positioned adjacent to said threaded surface, and wherein said locking member includes an inner wall and has a threaded surface sized and threaded to engage said threaded surface of said adaptor, said locking member movably positioned upon said chassis mounting portion and movable between:

said first unlocked position wherein said threaded surface of said locking member does not engage said threaded surface of said adaptor when said second central conductor of said adaptor and said first central conductor of said chassis mounting portion are electrically continuous, and said second locked position wherein said threaded surface of said locking member engages said threaded surface of said adaptor when said second central conductor of said adaptor and said first central conductor of said chassis mounting portion are electrically continuous, and wherein said inner wall of said locking member compresses said o-ring positioned adjacent to said threaded surface of said adaptor to thereby form an environmental seal between said chassis mounting portion and said adaptor.

18. The connector of claim 17, wherein said chassis mounting portion further comprises an o-ring located between said locking member and said chassis mounting portion, said o-ring forming an environmental seal between said locking member and said chassis mounting portion when said locking member is in said first unlocked position and when said locking member is in said second locked position.

* * * * *